US009409674B2

(12) United States Patent
Hidalgo Vargas

(10) Patent No.: US 9,409,674 B2
(45) Date of Patent: Aug. 9, 2016

(54) CONFIGURABLE, REPAIRABLE, AND RECYCLABLE CARGO PALLET

(71) Applicant: Cajas Para Exportación Retornables S.A., Santa Bárbara de Heredia (CR)

(72) Inventor: Edgar Hidalgo Vargas, Santa Bárbara de Heredia (CR)

(73) Assignee: Cajas Para Exportación Retornables S.A., Santa Bárbara de Heredia (CR)

( * ) Notice: Subject to any disclaimer, the term of this patent is extended or adjusted under 35 U.S.C. 154(b) by 0 days.

(21) Appl. No.: 14/428,821

(22) PCT Filed: Sep. 17, 2012

(86) PCT No.: PCT/CR2012/000003
§ 371 (c)(1),
(2) Date: Mar. 17, 2015

(87) PCT Pub. No.: WO2014/040575
PCT Pub. Date: Mar. 20, 2014

(65) Prior Publication Data

US 2015/0274358 A1 Oct. 1, 2015

(51) Int. Cl.
*B65D 19/12* (2006.01)
*B65D 19/00* (2006.01)
*B65D 19/44* (2006.01)

(52) U.S. Cl.
CPC ..... *B65D 19/0095* (2013.01); *B65D 19/0097* (2013.01); *B65D 19/44* (2013.01); (Continued)

(58) Field of Classification Search
CPC ..... B65D 2519/00273; B65D 2519/00323; B65D 2519/00034; B65D 2519/00069; B65D 2519/00033
USPC ..... 108/56.1, 56.3, 901, 902, 57.25, 51.11
See application file for complete search history.

(56) References Cited

U.S. PATENT DOCUMENTS 2,347,095 A * 4/1944 Garbarino ..... B65D 19/0075 108/56.1
3,878,796 A * 4/1975 Morrison ..... B65D 19/0075 108/56.1

(Continued)

FOREIGN PATENT DOCUMENTS

EP 0609611 A2 8/1994
WO 2011072624 A1 6/2011

OTHER PUBLICATIONS

International Search Report for International Application No. PCT/CR2012/000003 mailed May 22, 2013.

*Primary Examiner* — Jose V Chen
(74) *Attorney, Agent, or Firm* — Coats & Bennett, P.L.L.C.

(57) ABSTRACT

A configurable pallet that can be readily assembled to match the particular load requirements of an application. The pallet includes structural elongated platform members 10; 10' used in different configurations with either leg members 30 or reinforcement structural beams 20. Platform members 10' include conical protuberances 14'; 16' that are receivable within cooperating frustoconical openings 14; 16 or 14*a*; 16*a* that keep the structural members in place and perpendicularly to each other, in addition to the use of fastening members. When reinforcement beams 20 are used, the structural integrity of the pallet is enhanced to reduce the stress/relaxation wear thereby preventing or minimizing the possibilities of disengagement. A diaphragm plate 225 is optionally used to enhance the structural stability of beam 20.

18 Claims, 10 Drawing Sheets

(52) U.S. Cl.
CPC ..... *B65D2519/00029* (2013.01); *B65D 2519/00069* (2013.01); *B65D 2519/00104* (2013.01); *B65D 2519/00139* (2013.01); *B65D 2519/00273* (2013.01); *B65D 2519/00293* (2013.01); *B65D 2519/00323* (2013.01); *B65D 2519/00333* (2013.01); *B65D 2519/00338* (2013.01); *B65D 2519/00378* (2013.01); *B65D 2519/00567* (2013.01); *B65D 2519/00796* (2013.01); *B65D 2519/00835* (2013.01); *B65D 2519/00985* (2013.01)

(56) References Cited

U.S. PATENT DOCUMENTS

| | | | | | |
|---|---|---|---|---|---|
| 4,397,246 | A * | 8/1983 | Ishida | B65D 19/0012 | 108/55.3 |
| 5,191,843 | A * | 3/1993 | Ausavich | B65D 19/0026 | 108/56.1 |
| 5,351,628 | A * | 10/1994 | Breezer | B65D 19/0022 | 108/56.1 |
| 5,367,960 | A * | 11/1994 | Schleicher | B65D 19/0095 | 108/56.1 |
| 5,388,533 | A * | 2/1995 | Pigott | B65D 19/0012 | 108/56.1 |
| 5,417,167 | A * | 5/1995 | Sadr | B65D 19/0093 | 108/57.19 |
| 5,440,998 | A | 8/1995 | Morgan, IV et al. | | |
| 5,456,189 | A * | 10/1995 | Belle Isle | B65D 19/0095 | 108/57.17 |
| 5,673,629 | A * | 10/1997 | Ginnow | B65D 19/0095 | 108/56.1 |
| 5,941,179 | A * | 8/1999 | Herring | B65D 19/0091 | 108/56.3 |
| 6,006,677 | A * | 12/1999 | Apps | B65D 19/0012 | 108/56.1 |
| 6,029,583 | A * | 2/2000 | LeTrudet | B65D 19/0012 | 108/57.25 |
| 6,216,608 | B1 * | 4/2001 | Woods | B65D 19/0012 | 108/56.1 |
| 6,837,170 | B2 * | 1/2005 | Taft | B65D 19/0073 | 108/57.25 |
| 7,004,083 | B2 * | 2/2006 | Ramirez von Holle | B65D 19/0026 | 108/57.25 |
| 7,490,561 | B1 | 2/2009 | Chou | | |
| 7,578,244 | B2 * | 8/2009 | Williams, Jr. | B65D 19/0095 | 108/56.3 |
| 8,342,106 | B2 * | 1/2013 | Krupka | B65D 19/0095 | 108/57.25 |
| 8,448,582 | B2 * | 5/2013 | Jian | B65D 19/0097 | 108/56.3 |
| 8,627,773 | B2 * | 1/2014 | Storteboom | B65D 19/38 | 108/51.11 |
| 9,038,546 | B2 * | 5/2015 | Ten Bok | B65D 19/0048 | 108/57.17 |
| 2005/0237184 | A1 * | 10/2005 | Muirhead | B29C 47/0019 | 340/539.13 |
| 2005/0268824 | A1 | 12/2005 | Williams | | |
| 2007/0245932 | A1 * | 10/2007 | Nielsen | B65D 19/0093 | 108/51.11 |
| 2008/0066657 | A1 * | 3/2008 | Kuo | B65D 19/0095 | 108/57.19 |
| 2012/0132114 | A1 * | 5/2012 | Krupka | B65D 19/0095 | 108/57.25 |
| 2013/0160680 | A1 * | 6/2013 | Ten Bok | B29C 44/0407 | 108/50.11 |

* cited by examiner 26
25
24
21
16a
14a
15a
15
11
16
A 200
21
29
28
22
E 10
23
20
10
10'
20
19
18
225
D

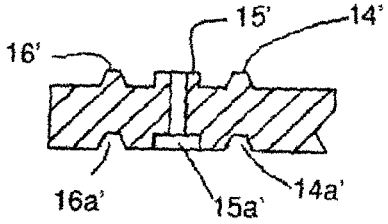
Fig. 3B
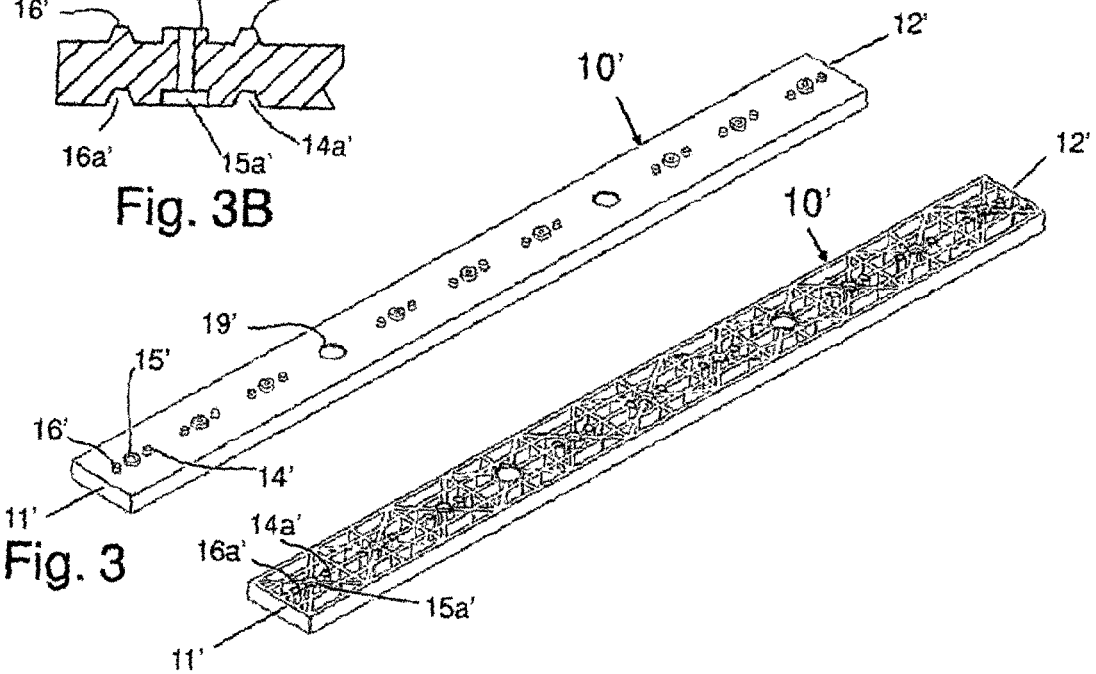
Fig. 3
Fig. 3A 10
19
14
15
16

10
12
19a
16a
15a
14a
11

18

CONFIGURABLE, REPAIRABLE, AND RECYCLABLE CARGO PALLET

This application is a 35 USC 371 application of International PCT Patent Application No. PCT/CR2012/000003 filed on Sep. 17, 2012, the entire content is hereby incorporated by reference herein.

TECHNICAL FIELD

1. Field of the Invention

The present invention relates to cargo pallets, and more particularly, to such pallets that are configurable, repairable, recyclable and adjustable to different load capacities.

2. Background Art

Several pallets have been designed in the past. One of the related references corresponds to applicant's published PCT patent application number PCT/CR09/000001. Patent application discloses a manufacturing method and the configuration of structural members to construct recyclable lightweight pallets that have configurable load capacity for multiple applications. However, the present invention is a new pallet that incorporates innovations to create a more versatile and efficient pallet for a wider range of load capacities, and still compatible with cost effective manufacturing processes for its components. The differences between the invention claimed herein and the PCT patent application include the use of frustoconical protuberances along central beams that are inserted into corresponding frustoconical holes in platform members for ready anti-rotation engagement enhancing stability, and rigidity of the pallet. Platform members that are volumetric efficient placed on both the top and bottom sides of the pallet with non-slip rubber blocks that protrude out from both sides of the platform members to prevent sliding of the loads or slippage of the forklift forks. Central beams designed to provide a calibrated ability to match loads of different capacities delivering the best weight to capacity ratio for the present invention. The wide load capacity range meets most, if not all, applications with minimal inventory logistics and ready on site assembly and repair, if necessary.

U.S. Pat. No. 5,458,069 consists of a skid, or pallet, made with central rails and cross members or runners perpendicularly connected to the rails at the top and bottom of the rails. The cross members are connected to the rails through the rail posts that are inserted into corresponding runner openings to which the posts are welded. As another option of connecting such runners to the rails, the posts are threaded and the runners have corresponding openings to receive such threaded posts and to fasten them with threaded nuts that lock the runners onto the rails. The rails have flanges and reinforcing ribs along both sides of their webs; the rails have two channels at their bottom side to insert a forklift to manipulate them.

U.S. Pat. No. 6,837,170 B2 consists of a pallet made with central stringers and deck members or runners perpendicularly connected to the stringers at the top and bottom of the stringers. The deck members are connected to the stringers through grooves, locking buttons, and locking sockets that on the top and bottom sides of the stringers are used for interlocking themselves with the deck members. The stringers have flanges and reinforcing ribs along both sides of their webs; the stringers also have two channels at their bottom side to insert a forklift to manipulate them.

US 2008/0105168 A1 patent application relates to pallets formed by single-piece platforms, or as other options, by platforms made with a grid structure obtained by connecting several deck boards perpendicularly to each other. Such platforms or grid structures make up the superior and inferior pallet surfaces, which are separated by cylindrical or rectangular spacing legs, and they are connected by threaded means to join such platforms while maintaining the spacing legs between the two platforms.

Patent WO 97/17263 consists of a pallet made with single-piece platforms to form the superior and inferior surfaces of the pallet, separated, and connected with blocks with engaging means to join both platforms and form the pallet.

U.S. Pat. No. 6,352,039 consists of a pallet made of thermoplastic material, which is formed by interconnecting several members without using mechanical connections but instead using adhesives or thermal welding.

U.S. Pat. No. 5,337,681 consists of a plastic recyclable pallet made by perpendicularly interlocking slats and rails.

U.S. Pat. No. 4,843,976 consists of a plastic pallet formed by two single-piece platforms with flat surfaces and joined by cylindrical spacers with interlocking connecting features.

U.S. Pat. No. 4,597,338 also consists of a plastic pallet formed by two single-piece platforms with flat surfaces, but joined by rectangular spacers that interlock to the platforms to form the pallet.

Even though several pallets have been designed in the past, the applicant believes that none of them discloses a design of a repairable, recyclable, and reusable cargo pallet with a modular structure, configurable load capacity, and with non-slip rubber surfaces to prevent sliding of the cargo on the pallet and of the pallet on the ground, shelf, and forklift. Additionally, the present invention includes the use of elongated plate members mounted to the beams that can be used to selectively enhance the reinforcement of the beams.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a volumetrically efficient pallet that can be configured, without requiring the use of specialized tools, to match the load capacity required for a given application.

It is another object of this present invention to provide such a pallet that is recyclable and resistant to the elements.

It is still another object of this present invention to provide such a pallet that can be stored and transported utilizing minimum space.

It is yet another object of this present invention to provide such a device that is inexpensive to manufacture and maintain while retaining its effectiveness.

Further objects of the invention will be brought out in the following part of the specifications, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 illustrates an isometric view of an embodiment for platform member 10', showing the upperside with sequences of groups of three longitudinally disposed protrusions: two frustoconical and between them a cylindrical protrusion with a central through hole.

FIG. 3A shows an isometric view of the underside of the platform member 10' shown in FIG. 3.

FIG. 3B shows a partial elevational view of platform member 10' shown in FIG. 3.

DETAILED DESCRIPTION OF THE PREFERRED EMBODIMENT

Figure 1A:
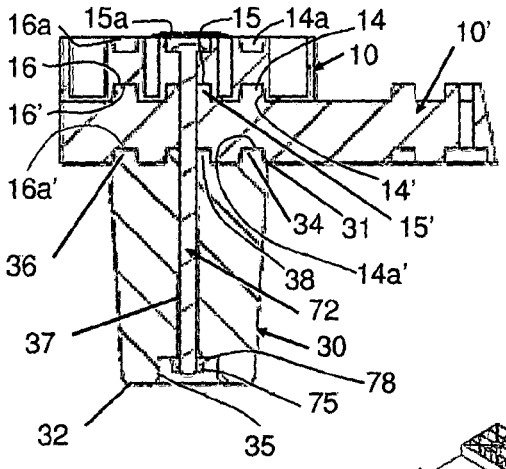
FIG. 1A is an elevational cross-sectional view taken along line 1A in FIG. 1.

Referring now to the drawings, where the present invention is generally referred to with numeral 1, it can be observed that it basically includes structural elongated platform members 10 and 10' used in different configurations with either leg members 30 or reinforcement structural beams 20. The number and characteristics of these members allow a user to configure pallets that will efficiently match the load requirements for the application at hand while optimizing the logistics for transporting and storing the pallet components in a volumetric efficient manner. The components are all recyclable and repairable on site without requiring specialized tools.

Figure 1:
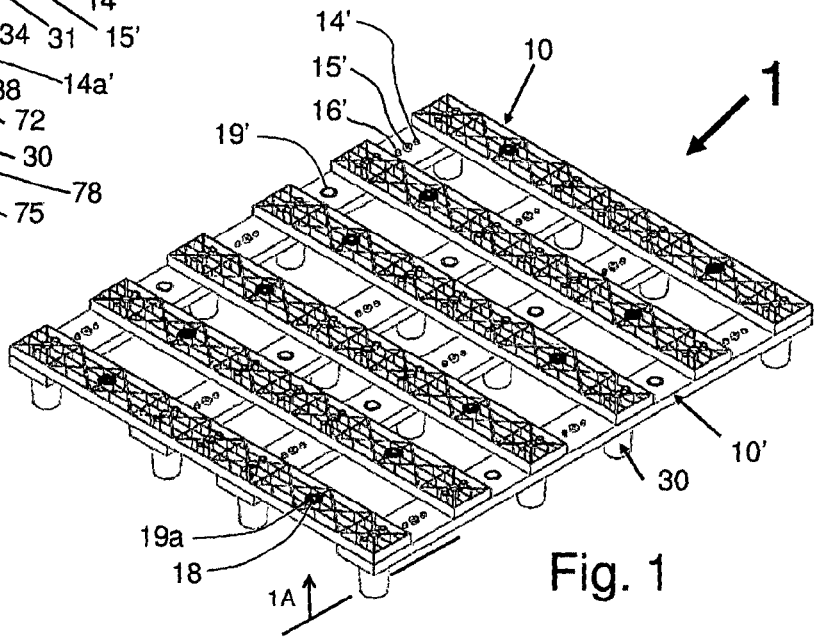
FIG. 1 is an isometric view of one of the embodiments for the present invention using six platform members 10 for the top of pallet 1 and four platform members 10' defining the bottom of the pallet, along with leg members 30 cooperatively mounted to members 10' and distributed to keep the pallet 1 at a spaced apart and parallel relationship with respect to a resting surface.

As it can be seen in FIG. 1, one of the basic configurations utilizes platform members 10 and 10' with leg members 30, all removably mounted, to configure a pallet for relatively low load applications. The minimum number of platform members 10 needed are three with three platform members 10'. In FIG. 1 a common configuration is shown with six members 10 defining the upperside of pallet 1 and four members 10' defining the underside. Members 10 are kept at a parallel and spaced apart relationship with respect to each other. The same is true for members 10'. Members 10 and 10' are perpendicularly disposed with respect to each other, as it can be best seen in FIG. 1.

Figure 6:
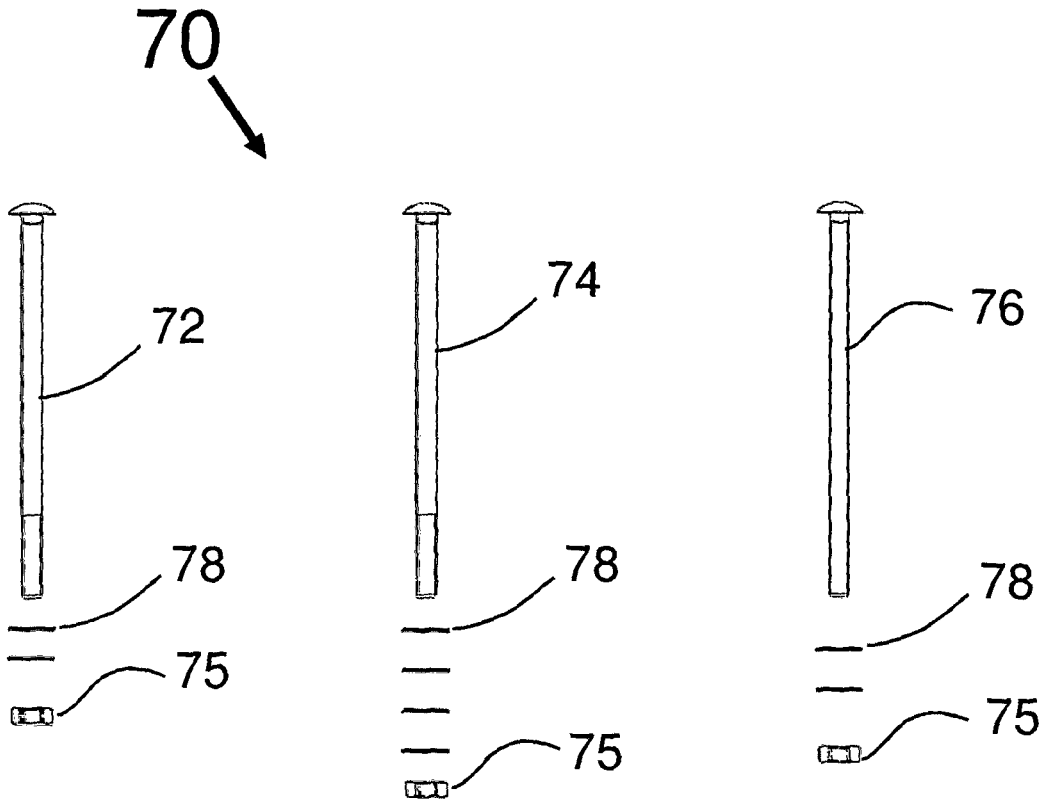
FIG. 6 shows an elevational view of three different sets of fastening members used to connect the platform members to themselves and/or to the beam members.
Figure 7:
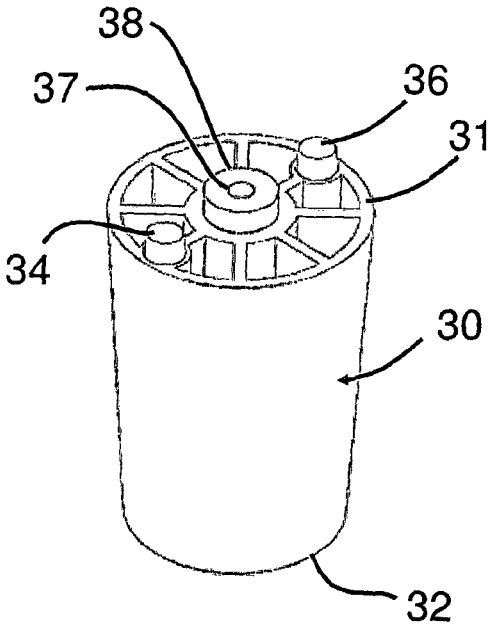
FIG. 7 is an inclined view of a leg member 30 used in the present invention.
Figure 7A:
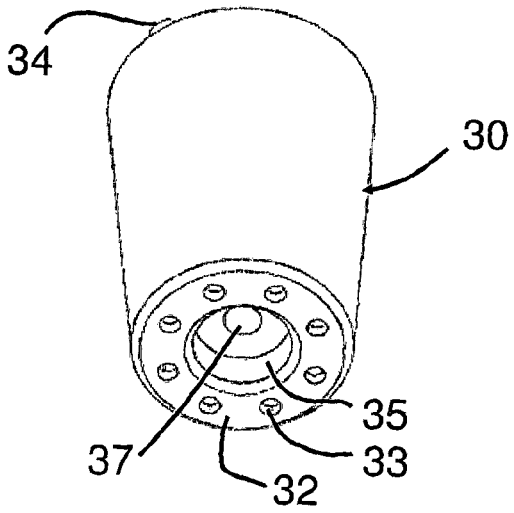
FIG. 7A is an isometric view of the leg member 30 shown in FIG. 7 showing the bottom of leg member 30.

FIG. 1A is a partial elevational cross-section of a corner of pallet 1 represented in FIG. 1, taken along cutting line 1A. It can be seen that this embodiment shows leg member 30 having a substantially frustoconical shape with tapered pins 34; 36 and cylindrical pin 38 at end 31 of leg member 30. Through opening 37 centrally and longitudinally extends from pin 38. The other end 32 includes drainage openings 33 to prevent the storage of water inside leg member 30. One way for implementing leg member 30 is shown in FIGS. 7 and 7A. A minimum of one pin, either 34 or 36, is needed to prevent the rotation caused in normal use of the pallet. Screw member 72 is shown in FIG. 1A passing through central through opening 37, washers 78 and mating with nut 75 tightening leg member 30 in place. Nut 75 is housed within counter base 35. Screw member 72 provides a rigid core for leg member 30 while at the same time members 10 and 10' are securely fastened. Pins 34 and 36 prevent any rotational movement that would tend to loosen the mechanical engagement of members 10, 10', and 30. Several fastening members generally referred to with numeral 70 are shown in FIG. 6. Depending on the use and characteristics of the elements being mounted together one or the other is used.

FIGS. 3 and 3A shows the upperside and underside of platform member 10'. The upperside includes sets of three protrusions, in this embodiment, namely, frustoconical protrusions 14'; 16' and cylindrical protrusion 15', that are longitudinally aligned. One set is located, at a predetermined location, adjacent to end 11' and another set is located adjacent to end 12'. Opposite to protrusions 14'; 16' and 15', as seen in FIG. 3A, are holes 14*a*'; 16*a*' and 15*a*', respectively.

Figures 4, 4A, 4B:
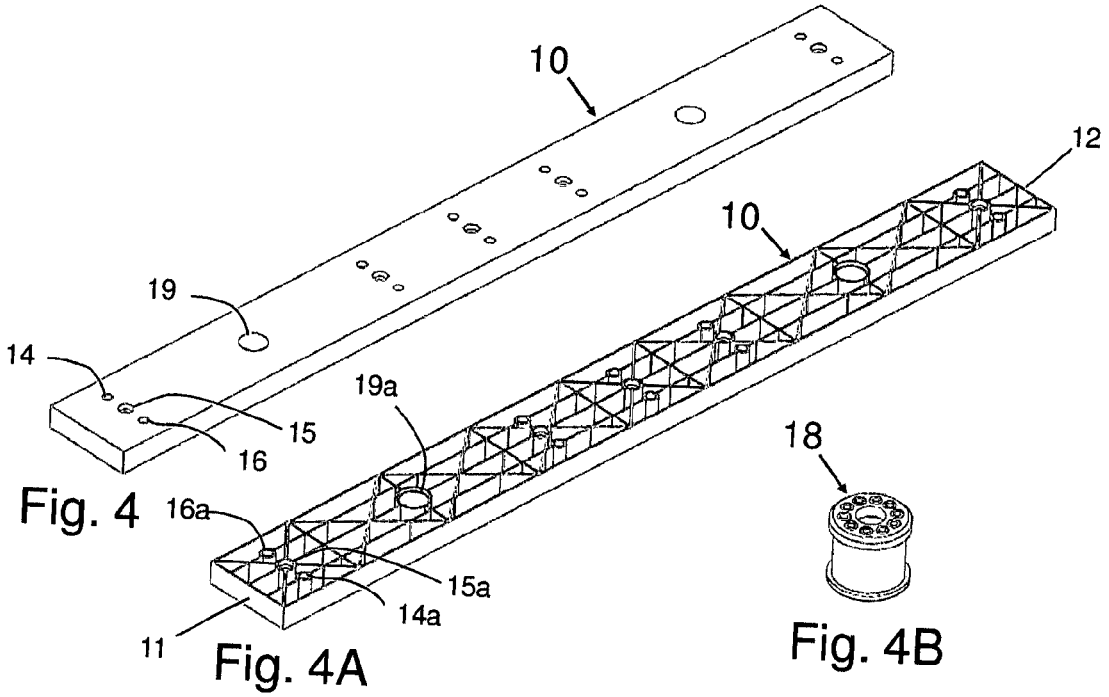
FIG. 4 illustrates an isometric view of an embodiment for platform member 10, showing the upperside.
FIG. 4A shows an isometric view of the other (bottom) side of the platform member 10 shown in FIG. 4.
FIG. 4B shows an isometric view of an anti-skid rubber block.
Figure 5B:
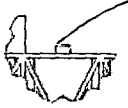
FIG. 5B is an enlarged detail view of a portion of the pallet shown in FIG. 5A.
Figure 5A:
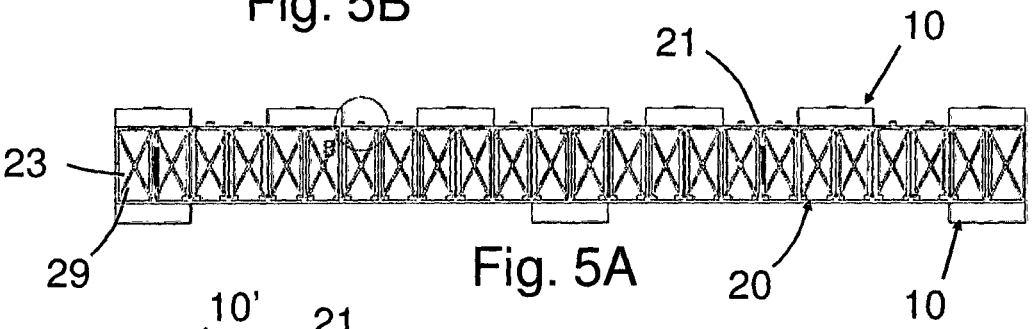
FIG. 5A is an end elevational side view of a pallet represented in FIG. 2B showing the central beam extending longitudinally with end views of seven platform members 10 defining the top of the pallet and three platform members 10 defining the bottom.
Figure 5:
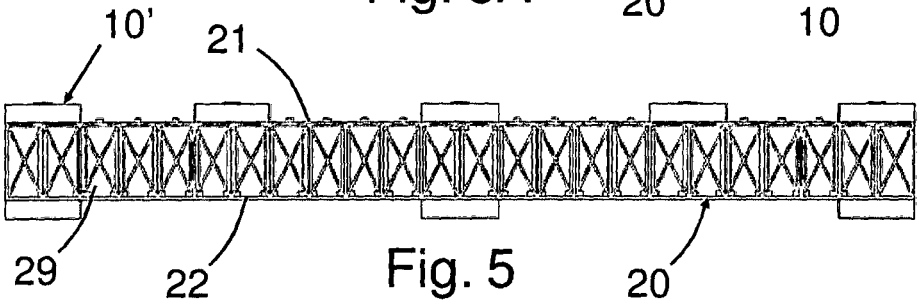
FIG. 5 is an end elevational side view of the pallet shown in FIG. 2 with beam 20 extending longitudinally at front and platform members 10 seen from their ends.
Figure 5C:
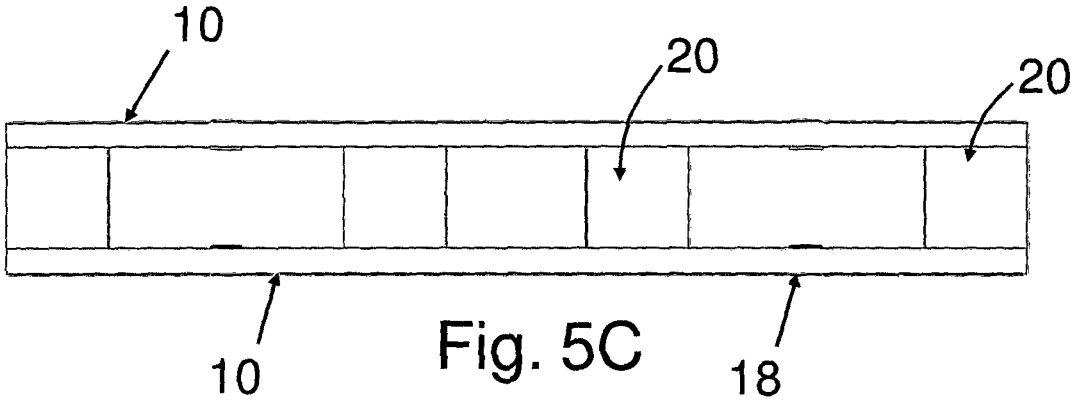
FIG. 5C is an end elevational side view of the pallet shown in FIG. 2 with beam 20 seen from the ends and platform members 10 extending longitudinally at the front.

Platform members 10, as shown in FIG. 4, extend longitudinally for a predetermined distance that is typically compatible with commercial cargo containers. One side, that is referred to as the upperside, is substantially flush with the exception of groups or sets of holes 14; 15; 16 that are transversally disposed at predetermined locations along member 10. One set is located adjacent to end 11 and another set is located at end 12. Holes 15 is a through cylindrical hole while holes 14 and 16 have frustroconical internal cavities to cooperatively receive cylindrical pin 15' and frustoconical protrusions 14' and 16', respectively. The other side, referred to as the underside, has frustoconical holes 14*a*; 16*a* and cylindrical through hole 15*a*, similar and opposite to holes 14; 16 and 15, respectively. The former also cooperatively receive frustoconical protrusions 14'; 16' and cylindrical protrusion 15'.

As discussed above, cylindrical through holes 15; 15*a* and 15*a'* cooperatively align to permit screw 74 to pass through and through central opening 38 of leg member 30. And this engagement is possible also if members 10 are flipped (one or more) to provide a substantially flush surface if desired.

Through opening 19 on the upperside of member 10 in FIGS. 4 and 19*a* in FIG. 4A, removably receives rubber block 18 to provide an anti-skid action on the upperside and underside of member 10. Through openings are spaced apart to cover different areas of the pallet's top and bottom surface where the load lies and where the forklift engages.

Figures 2, 2A:
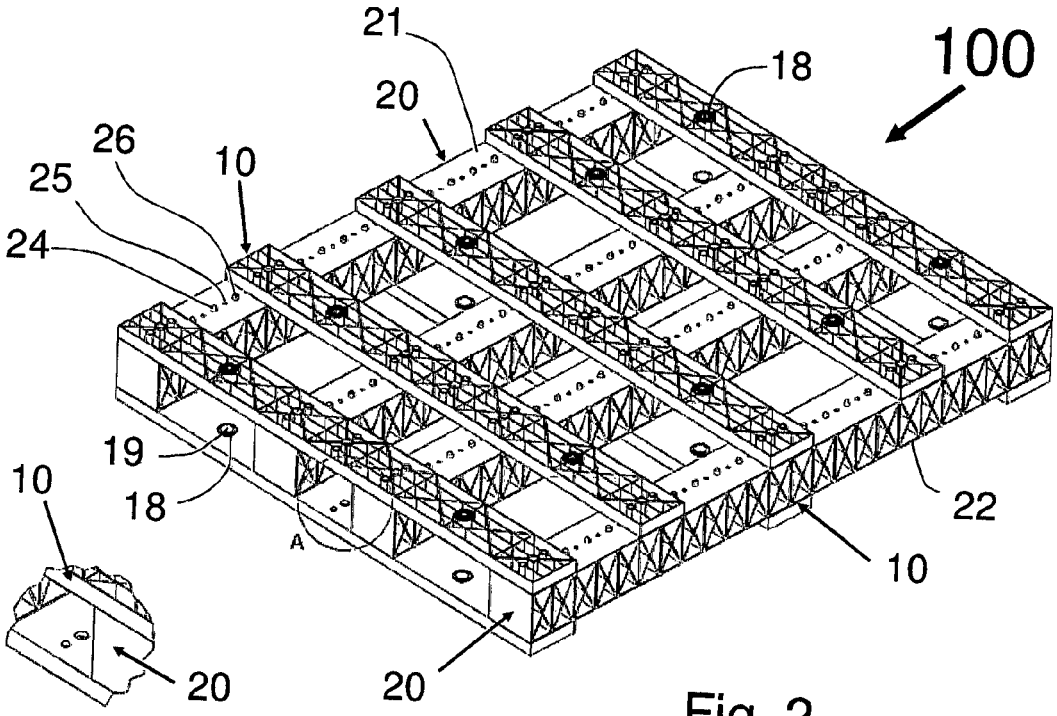
FIG. 2 represents an isometric view of one of the embodiments for the pallet incorporating the present invention having four beam members and five platform members 10 to define the top of the pallet and three platform members 10 defining its bottom.
FIG. 2A shows an enlarged detail view of a portion of the pallet shown in FIG. 2.

As it can be seen in the design configuration shown in FIG. 2, a pallet 100 intended for larger loads can be configured using five platform members 10 to define the pallet's top and three platform members 10 to define the bottom. Between the top and bottom, four reinforcement beam members 20 are mounted perpendicularly with respect to members 10. Members 10 at the top are coplanarly kept at a spaced apart and parallel relationship with respect to each other and the same is true for those defining the bottom of pallet 100, when beam members 20 are used. The load enhancement introduced by beam member 20 also reduces the deflections created by stress/relaxation changes that cause the fastening members to become loose.

In FIG. 2A, a detail view of portions of two members 10 a beam 20 are shown. The frustoconical protrusions 24 and 26 and cylindrical protrusions 25 of the latter engage a set of frustoconical holes 14;16 and cylindrical through hole 15 of the former are not shown but an adjacent set of holes is seen where these members 10 and beam 20 could have also been mounted. These sets of frustoconical holes 14; 16 and cylindrical holes 15 along with corresponding frustoconical protrusions 24 and cylindrical protrusions 25 on beam 20 are cooperatively disposed along members 10 and beams 20 to provide the best structurally balanced possible configurations while permitting the use of forklifts to manipulate pallet 100.

Figures 2B, 2C, 2D, 2E:
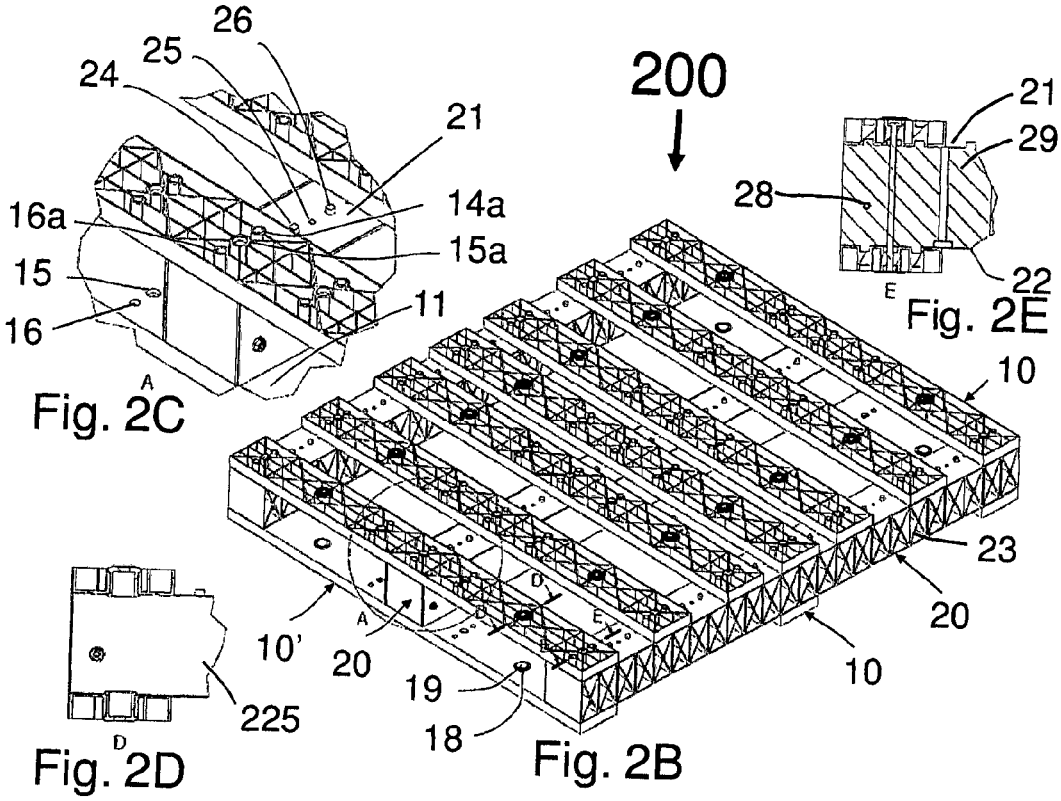
FIG. 2B represents an isometric view of another configuration for the pallet incorporating the present invention having three beams 20 and seven platform members 10 defining the top and three platform members 10 defining the bottom. This figure also shows a reinforcement diaphragm plate mounted against a lateral wall of a beam member 20 having the height of beam member 20.
FIG. 2C shows an enlarged isometric detail view of a portion of the pallet shown in FIG. 2B.
FIG. 2D shows an enlarged partial cross-sectional view, taken along cutting line 2D in FIG. 2B of a portion of the pallet.
FIG. 2E shows an enlarged partial cross-sectional view, taken along cutting line 2E in FIG. 2B of a portion of the pallet.

Another configuration is shown in FIG. 2B to provide a pallet 200 with larger load capacity. In this configuration seven platform members 10 and three platform members 10 are used at the top and bottom, respectively, of pallet 200. A stronger and larger supporting surface is provided while keeping the same number of platform members 10 for the pallet's bottom. Only three beam members 20 are used. Beam members 20 are cooperatively spaced from each other to permit a forklift's forks to pass between beams 20. A plate 225 is used to reinforce beams 20.

In some applications, such as medical supplies loads, it is preferred to provide a substantially flush surface for the top of the pallet. For these applications, platform members 10 at the top, in FIGS. 2 and 2B, can be flipped.

Beam members 20 have predetermined cooperative dimensions to permit the assembly of pallets compatible with the loads and transportation limitations. Typically, the dimensions are selected to be compatible with conventionally available containers. Beam members 20 include and upper wall 21 and a lower wall 22, along with longitudinally extending lateral walls 23; 23'. Web 29 separates walls 21 from 22 and provides the necessary efficient (with minimum weight) rigidity to this reinforcement structural member. Upper wall 21 includes frustoconical pins 24 and 26 and cylindrical pins 25, alternating each other, that are receivable within frustoconical holes 14*a*; 16*a* and cylindrical through holes 15*a*, respectively. The engagement of the frustoconical pins 24 and 26 to holes 14*a* and 16*a* prevent rotational movements. The engagement of cylindrical pins 25 with cylindrical through holes 15*a* permit screw members 74 to pass through for fastening the two structural elements.

Figure 8A:
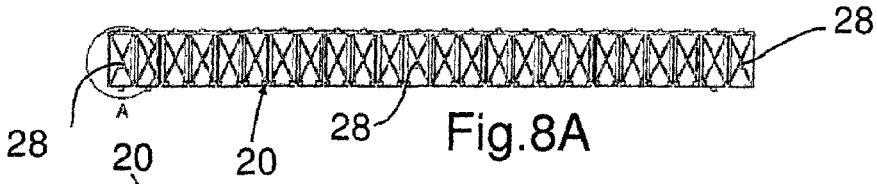
FIG. 8A is a side elevational view of beam member 20 represented in FIG. 8 showing three tubular sleeves 28 through which screw members 27 are passed and nuts 27' mounted to the distal ends of screw members 27.
Figure 8B:
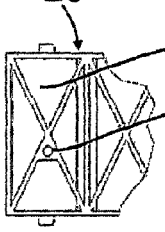
FIG. 8B is an enlarged detail view of an end of beam member 20 showing the position of tubular sleeve 28.
Figure 8:
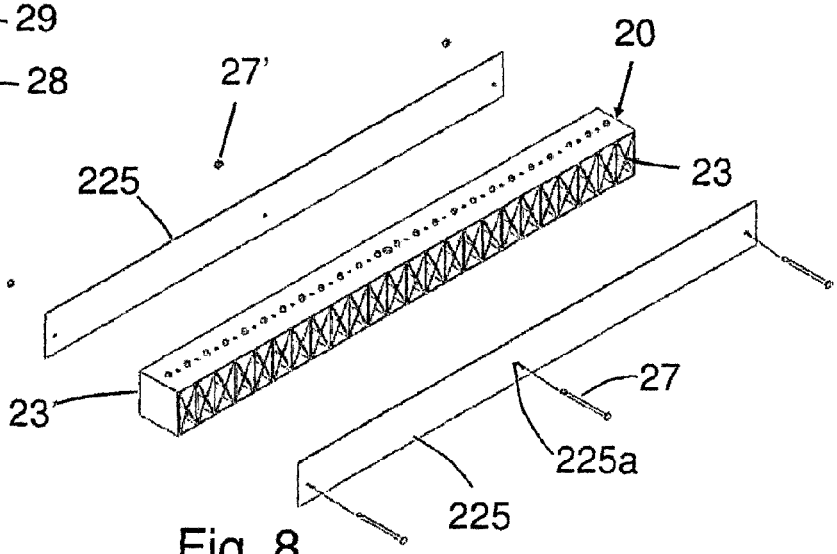
FIG. 8 is an isometric view of a beam member 20 to which reinforcement plates 225 are being added.

In FIG. 8, an alternate embodiment is shown where beam member 220 includes elongated reinforcement diaphragm plates 225 removably mounted to lateral walls 23 and 23'. Or, optionally, only one lateral wall 23 or 23' is reinforced with one plate 225. Sleeves 28 are mounted to web 29, at predetermined locations, and receive therein screw members 74 that pass therethrough. Plates 225 provide a volumetrically efficient way to substantially enhance the load capacity of beam 20 minimizing their deflection and stress/relaxation effects that might end up loosening the pallet's structure.

In use, a user can readily assemble a pallet for the particular load capacity requirements of the application without being harnessed to a specific design that more than likely will exceed considerably the needs of the application. Then, if the pallet needs to be returned (in many instances the pallets are used one way only because of demand or other factors) then the different components are stored and transported in a volumetrically efficient manner.

INDUSTRIAL APPLICABILITY

It is apparent from the previous paragraphs that an improvement of the type for such a pallet is quite desirable for the efficient transportation of cargo, as well as the ability to repair the pallets from components that can be readily kept in inventory. The volumetric efficient storage of the units for transportation back to where the pallet was originally shipped from, also enhances the value of the present invention.

What is claimed is:

1. A pallet, comprising:

at least two elongated structural platform first members, each having two end sides, two lateral sides, an upper side and an underside, said first members are kept at a parallel and spaced apart relationship with respect to each other;

at least two elongated structural platform second members, each having two end sides, two lateral sides, an upper side and an underside, said first members are kept at a parallel and spaced apart relationship with respect to each other, and at least two of said first members and at least two of said second members mounted to each other at their respective first and second ends to form a structure having a rectangular projection; and at least four leg members removably mounted to said underside of said first members thereby keeping said pallet at a substantially parallel and spaced apart relationship with respect to a resting surface;

a plurality of solid frustoconical protrusions are perpendicularly formed on the upper sides of said first members, wherein the solid frustoconical protrusions are conical in shape from the base to the top of the protrusion; and a corresponding plurality of frustoconical holes are cooperatively disposed and dimensioned to receive said solid frustoconical protrusions in the underside of the second members to prevent rotation of said first members with respect to said second members, wherein the frustoconical holes have a corresponding shape to receive the solid frustoconical protrusion.

2. The pallet set forth in claim 1, wherein said platform members include a reinforcement web rigidly mounted interiorly from said upper side and lateral sides with distal ends that define said underside.

3. The pallet set forth in claim 2, wherein said first and second numbers include each a plurality of through holes passing through said first and second members, cooperatively positioned to coincide with each other when said first and second members are brought in abutting relationship with respect to each other, and further including a fastener for mounting said first and second members together and passing through said through holes.

4. The pallet set forth in claim 3 further including:

at least one anti-skid assembly for preventing the movement of a load mounted on said second members.

5. The pallet set forth in claim 4, wherein said frustoconical holes and said through holes of said second members are grouped in sets located at predetermined locations that cooperative receive said solid frustoconical protrusions of said first members and coincide with said through holes of said first members' upper sides.

6. The pallet set forth in claim 4, having three first members, equally spaced apart from each other so that sufficient space is provided to receive the forks of a forklift truck.

7. The pallet set forth in claim 4, wherein said anti-skid assembly includes a rubber block.

8. The pallet set forth in claim 3, wherein each of said leg members have a frustoconical shape.

9. The pallet set forth in claim 8, wherein said leg members include at least one off-centered tapered pin and the undersides of said first members include at plurality of cooperating frustoconical holes for receiving said tapered pins so that rotation of said leg members is prevented.

10. A pallet, comprising:

at least four elongated structural platform members, each having two end sides, two lateral sides, an upper side and an underside, wherein at least two of said platform members define a first group of first platform members that are kept at a parallel and spaced apart relationship with respect to each other and at least two of said platform members defining a second group of second platform members that are kept at a parallel and spaced apart relationship with respect to each other; and at least two elongated structural reinforcement beam members kept at a parallel and spaced apart relationship with respect to each other, each of said beam members including two end walls, two lateral walls, an upper wall and an lower wall, said lower wall being removably mounted to the upper sides of said first platform members and said upper wall being removably mounted to said undersides of said second platform members resulting in a pallet configuration with a rectangular projection, and said beam members having a cooperative separation from each other to removably receive the forks of a forklift truck;

a plurality of solid frustoconical protrusions formed in the upper and lower walls at predetermined locations and said platform members including a plurality of frustoconical holes for cooperatively receiving said solid frustoconical protrusions to prevent rotational movements of said platform members with respect to each other, wherein the solid frustoconical protrusions are conical in shape from the base to the top of the protrusion and the frustoconical holes have a corresponding shape to receive the solid frustoconical protrusion.

11. The pallet set forth in claim 10, wherein platform members and said beam members include a plurality of cooperating through holes and a respective plurality of fastening means passing through said through holes for rigidly securing said platform members against said beam members.

12. The pallet set forth in claim 11, wherein each of said beam member includes a longitudinally extending web structure between said upper wall and lower walls.

13. The pallet set forth in claim 12, further including:

at least one anti-skid assembly for preventing the movement of a load mounted on said second members.

14. The pallet set forth in claim 10, wherein at least one of said beam members includes at least one elongated diaphragm plate mounted to at least one of the lateral walls to enhance the rigidity of said at least one of said beam members.

15. The pallet set forth in claim 14, wherein said upper and lower walls include a plurality of solid frustoconical protrusions at predetermined locations and said platform members including a plurality of frustoconical holes for cooperatively receiving said frustoconical protrusions to prevent rotational movements of said platform members with respect to each other.

16. The pallet set forth in claim 15, wherein platform members and said beam members include a plurality of cooperating through holes and a respective plurality of fastening means passing through said through holes for rigidly securing said platform members against said beam members.

17. The pallet set forth in claim 16, wherein said beam member includes a longitudinally extending web structure between said upper wall and lower walls.

18. The pallet set forth in claim 17, further including:

at least one anti-skid assembly for preventing the movement of a load mounted on said second members.

* * * * *